US010738538B2

(12) United States Patent
Azar

(10) Patent No.: US 10,738,538 B2
(45) Date of Patent: Aug. 11, 2020

(54) BLADE GEOMETRY FOR FIXED CUTTER BITS

(71) Applicant: SMITH INTERNATIONAL, INC., Houston, TX (US)

(72) Inventor: Michael G. Azar, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 179 days.

(21) Appl. No.: 15/570,632

(22) PCT Filed: Apr. 26, 2016

(86) PCT No.: PCT/US2016/029393
§ 371 (c)(1),
(2) Date: Oct. 30, 2017

(87) PCT Pub. No.: WO2016/176221
PCT Pub. Date: Nov. 3, 2016

(65) Prior Publication Data

US 2018/0355671 A1 Dec. 13, 2018

Related U.S. Application Data

(60) Provisional application No. 62/155,323, filed on Apr. 30, 2015.

(51) Int. Cl.
*E21B 10/43* (2006.01)
*E21B 10/567* (2006.01)
(Continued)

(52) U.S. Cl.
CPC ..... *E21B 10/43* (2013.01); *E21B 10/42* (2013.01); *E21B 10/5673* (2013.01); *E21B 10/62* (2013.01); *E21B 2010/425* (2013.01)

(58) Field of Classification Search
CPC ..... E21B 10/43; E21B 10/42; E21B 10/5673; E21B 10/62; E21B 2010/425
(Continued)

(56) References Cited

U.S. PATENT DOCUMENTS

2008/0035387 A1 2/2008 Hall et al.
2009/0283325 A1 11/2009 Plazas
(Continued)

FOREIGN PATENT DOCUMENTS

WO WO2014159838 A1 10/2014

OTHER PUBLICATIONS

International Preliminary Report on Patentability issued in International Patent Application No. PCT/US2016/029393 dated Nov. 9, 2017, 14 pages.
(Continued)

*Primary Examiner* — Anna M Momper
*Assistant Examiner* — Patrick F Lambe

(57) ABSTRACT

A downhole tool includes a tool body, at least one blade with a front face having an undulating geometry including a plurality of ridges and valleys, and a top face facing outwardly from the tool body and transitioning to the front face at a cutting edge. At least one cutting element is in a pocket at the cutting edge. The at least one cutting element has a non-planar cutting face facing in the same direction as the front face. The non-planar cutting face has at least two sloping surfaces meeting at an elongated crest, valley, or other feature. A portion of the elongated feature adjacent the front face may substantially align with, and have substantially corresponding geometry as, a ridge or valley of the front face.

20 Claims, 8 Drawing Sheets

(51) Int. Cl.
*E21B 10/42* (2006.01)
*E21B 10/62* (2006.01)

(58) Field of Classification Search
USPC ..... 175/430
See application file for complete search history.

(56) References Cited

U.S. PATENT DOCUMENTS

| | | | | |
|---|---|---|---|---|
| 2011/0192651 | A1 | 8/2011 | Lyons et al. | |
| 2014/0360789 | A1 | 12/2014 | Siracki et al. | |
| 2017/0211357 | A1* | 7/2017 | Grosz | E21B 10/42 |

OTHER PUBLICATIONS

International Search Report and Written Opinion issued in International Patent application PCT/US2016/029393, dated Aug. 16, 2016, 21 pages.

* cited by examiner

BLADE GEOMETRY FOR FIXED CUTTER BITS

CROSS-REFERENCE TO RELATED APPLICATIONS

This application claims priority to, and the benefit of, U.S. patent application Ser. No. 62/155,323, filed Apr. 30, 2015, which application is incorporated herein by this reference in its entirety.

BACKGROUND

Drag bits, often referred to as "fixed cutter drill bits," include bits that have cutting elements attached to the bit body. A drag bit may have a bit body made from steel, or from a matrix material such as tungsten carbide surrounded by a binder material. Drag bits may generally be defined as bits that have no moving cones; however, there are different types and methods of forming drag bits. For example, drag bits having abrasive material (e.g., diamond) impregnated into the surface of the material that forms the bit body are commonly referred to as "impreg" bits. Drag bits having cutting elements made of an ultra hard cutting surface layer or "table" (e.g., made of polycrystalline diamond or polycrystalline boron nitride materials) deposited onto or otherwise bonded to a substrate are known in the art as polycrystalline diamond compact ("PDC") bits.

SUMMARY

Some embodiments of the present disclosure relate to a downhole cutting tool that includes a tool body and at least one blade extending from the tool body. The blade may have a front face with an undulating geometry including alternating ridges and valleys, and a top face facing outwardly from the tool body and transitioning to the front face at a cutting edge. A cutting element may be in a pocket at the cutting edge of the blade. The cutting element may have a non-planar cutting face facing in the same direction as the front face. The non-planar cutting face may have at least two sloping surfaces meeting at an elongated crest.

In some embodiments, a downhole tool includes a tool body with a blade extending from the tool body. The blade includes a top face facing outwardly from the tool body, a front face that interfaces with the top face at a cutting edge, and a pocket at the cutting edge. The pocket has an inner wall with a varying length such that an opening of the pocket to the front face has a non-planar geometry around the perimeter of the opening. A cutting element may be in the pocket, and may have a non-planar cutting face with a non-planar geometry along peripheral edge of the non-planar cutting face. The non-planar geometry of the pocket opening may substantially correspond with the non-planar geometry of the cutting element along the peripheral edge of the non-planar cutting face.

In some embodiments, a method is provided for manufacturing a cutting tool having a tool body with a blade extending from the tool body. The blade has a front face having an undulating geometry including alternating ridges and valleys. A top face of the blade faces outwardly from the tool body and interfaces with the front face at a cutting edge. A pocket is located at the cutting edge. The method includes placing a cutting element in the pocket. The cutting element has a non-planar cutting face including at least two sloping surfaces meeting at an elongated crest, valley, or other feature. The method further includes orienting the at least one cutting element such that the elongated feature substantially aligns with a ridges or valley of the front face.

This summary is provided to introduce a selection of concepts that are further described in the detailed description. This summary is not intended to identify key or essential features of the claimed subject matter, nor is it intended to be used as an aid in limiting the scope of the claimed subject matter. Other aspects and advantages of the claimed subject matter will be apparent from the following description and the appended claims.

DETAILED DESCRIPTION

Some embodiments disclosed herein generally relate to downhole cutting tools having cutting elements with non-planar cutting ends or faces (also referred to herein as non-planar cutting elements). The geometry of the cutting tool supporting material around a non-planar cutting element may correspond with the geometry of the non-planar cutting end. For example, in one or more embodiments where a downhole tool includes at least one non-planar cutting element on a blade, the blade may have an undulating or contoured blade surface corresponding to adjacent peripheral edges of the non-planar cutting faces of the cutting elements.

Figure 1:
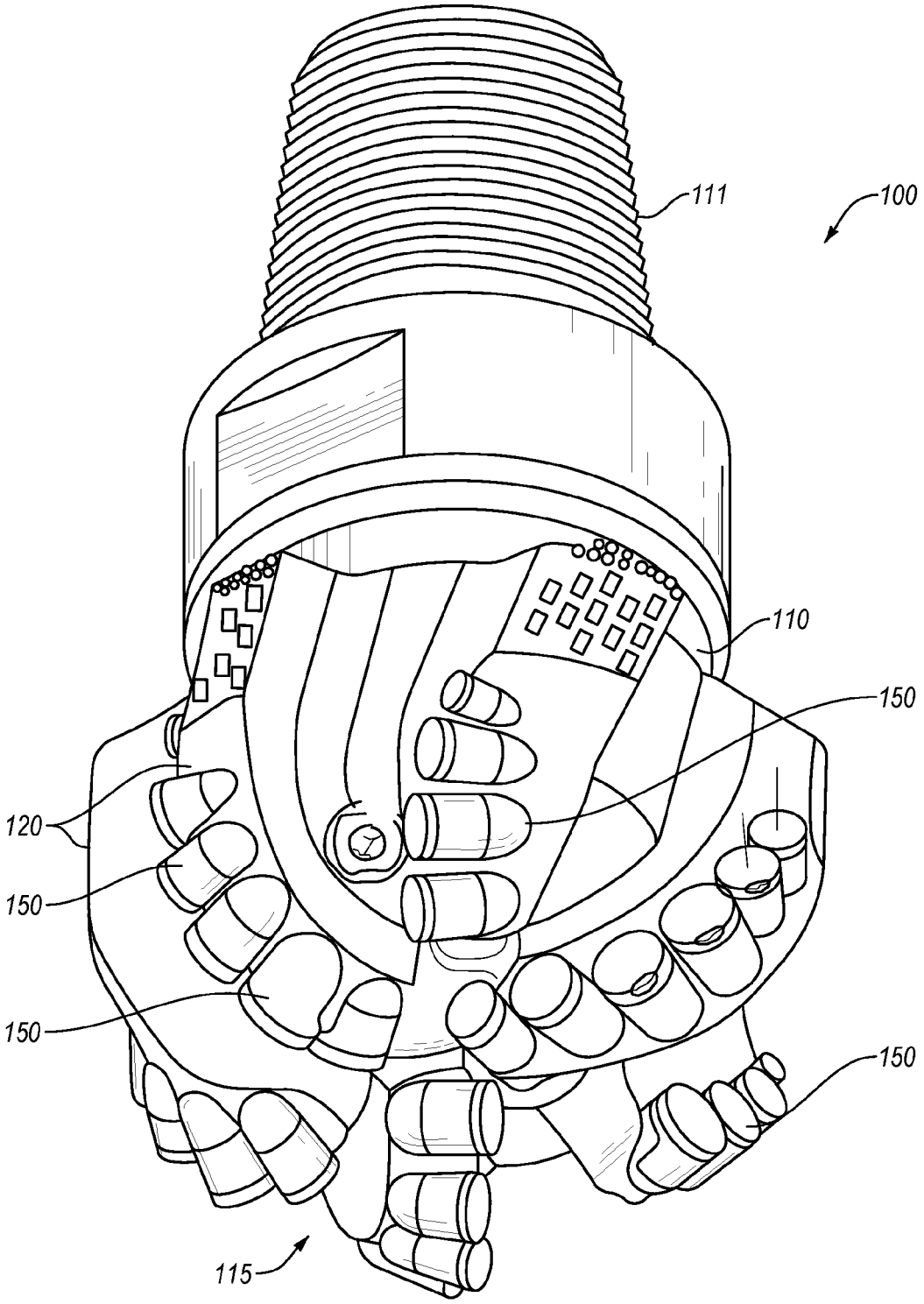
FIG. 1 shows a drag bit according to some embodiments of the present disclosure.

An example of a drag bit having a plurality of cutting elements with ultrahard working surfaces is shown in FIG. 1. The bit 100 includes a bit body 110 having a threaded upper pin end 111 and a cutting end 115. The cutting end 115 generally includes a plurality of ribs or blades 120 arranged about the rotational axis (also referred to as the longitudinal or central axis) of the drill bit and extending radially outward from the bit body 110. Cutting elements, or cutters, 150 are embedded in or otherwise coupled to the blades 120 at predetermined angular orientations and radial locations relative to a working surface, and with a set back rake angle and side rake angle against a formation to be drilled.

Figure 2:
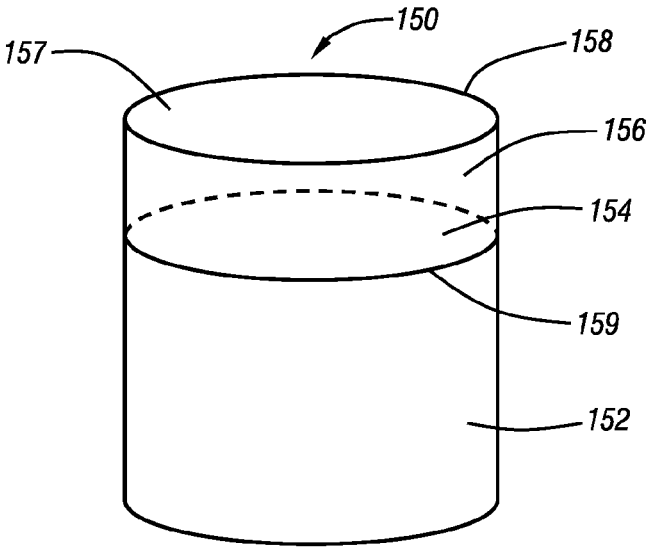
FIG. 2 shows a cutting element, in accordance with some embodiments of the present disclosure.

FIG. 2 shows an example of a cutting element 150 having a cylindrical cemented carbide substrate 152 with an end face or upper surface referred to as a substrate interface surface 154. An ultrahard material layer 156, also referred to as a cutting layer, has a top surface 157, also referred to as a working surface, a cutting edge 158 around the top surface, and a bottom surface, referred to as an ultrahard material layer interface surface 159. The ultrahard material layer 156 may include any suitable ultrahard material, such as polycrystalline diamond or polycrystalline cubic boron nitride. The ultrahard material layer interface surface 159 may be bonded to the substrate interface surface 154 to form a planar interface between the substrate 152 and ultrahard material layer 156. In some embodiments, the ultrahard material layer 156 may be omitted, and the entire cutting element 150 may be formed of a same material (e.g., tungsten carbide). For instance, when a bit (e.g., bit 100 of FIG. 1) is used for milling casing or another downhole material, tungsten carbide cutting elements 150 may be used in lieu of polycrystalline diamond or cubic boron nitride cutting elements.

Figure 3:
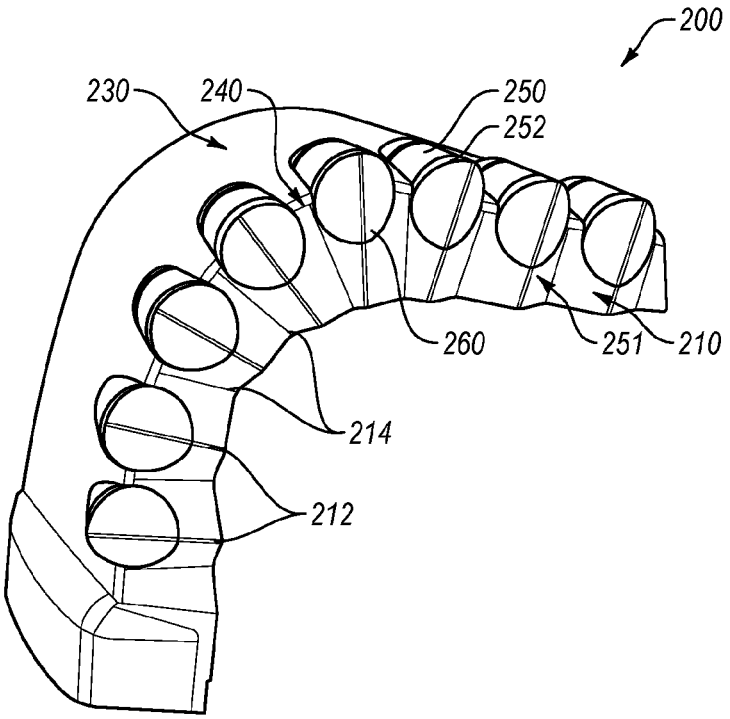
FIGS. 3-5 show a blade of a drag bit, according to some embodiments of the present disclosure.
Figure 4:
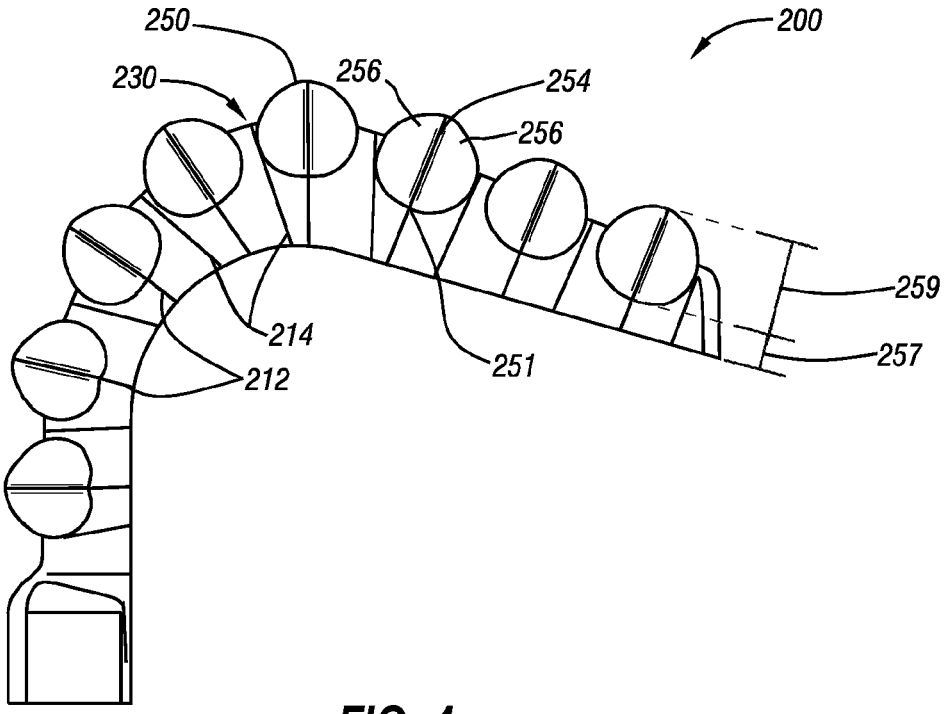
Figure 5:
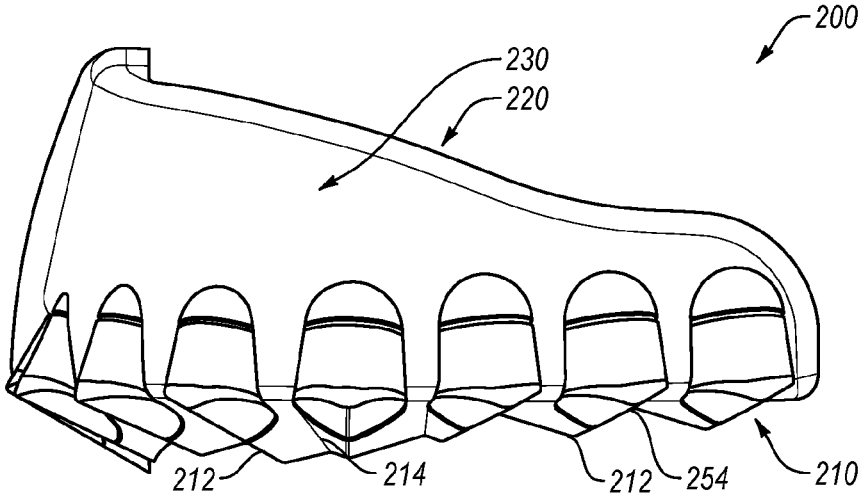

FIGS. 3-5 show a perspective view, a front view and a top view, respectively, of a blade 200 of a downhole cutting tool (e.g., a drill bit, a mill, etc.) that includes a front face 210 facing in the direction of cutting, a trailing face 220 opposite the front face 210, a top face 230 (or formation facing face) extending between the front face 210 and the trailing face 220, and a cutting edge 240 at the transition or interface of the top face 230 to the front face 210. The cutting edge 240 may be an interface with an angled transition, a chamfered transition, a smooth transition having a varying radius of curvature, or a radiused transition. The front face 210 may have an undulating geometry that includes a plurality of alternating ridges 212 and valleys 214. Cutting elements 250 are in corresponding pockets 260 at the cutting edge 240 of the blade 200. The cutting elements 250 have non-planar cutting faces 252 and are positioned in the pockets 260 such that the non-planar cutting faces 252 generally face in the same direction as the contours of the front face 210. In the embodiment shown, the non-planar cutting faces 252 have two sloping surfaces 256 meeting at an elongated crest 254 extending a full or partial diameter of the cutting face 252. In other embodiments, one or more non-planar cutting elements coupled to a blade may have a non-planar cutting face with a different geometry (e.g., more than one elongated crest extending from an outer perimeter of the non-planar cutting face, one or more peaks along the outer perimeter of the non-planar cutting face, etc.). In some embodiments, the elongated crest may instead include an elongated valley with two sloping surfaces that slope upwardly away from the elongated valley. The elongated crest and elongated valley may therefore be elongated features adjacent sloping surfaces.

A portion of the blade front face 210 adjacent to the interface 251 between the outer perimeter of the non-planar cutting face 252 and the inner wall of the pocket 260 and a portion of the cutting element cutting face 252 adjacent to the interface 251 may have substantially corresponding geometry and may be substantially aligned (e.g., the cutting face 252 may have an elongated crest 254 aligned with a ridge 212 in the front face 210). The adjacent portions of the non-planar cutting face 252 and the surrounding front face 210 having corresponding geometry may each extend a distance from the interface 251. For example, as shown in FIGS. 3-5, a ridge 212 may align with an elongated crest 254, where adjacent portions of the cutting face 252 and front face 210 within distances 257, 259 of the interface 251, the ridge 212 aligns with the elongated crest 254. In some embodiments, the elongated crest 254 may have substantially the same radius of curvature as the corresponding ridge 212, or in other embodiments, the elongated crest 254 may have a different radius of curvature than the corresponding ridge 212.

Figure 6:
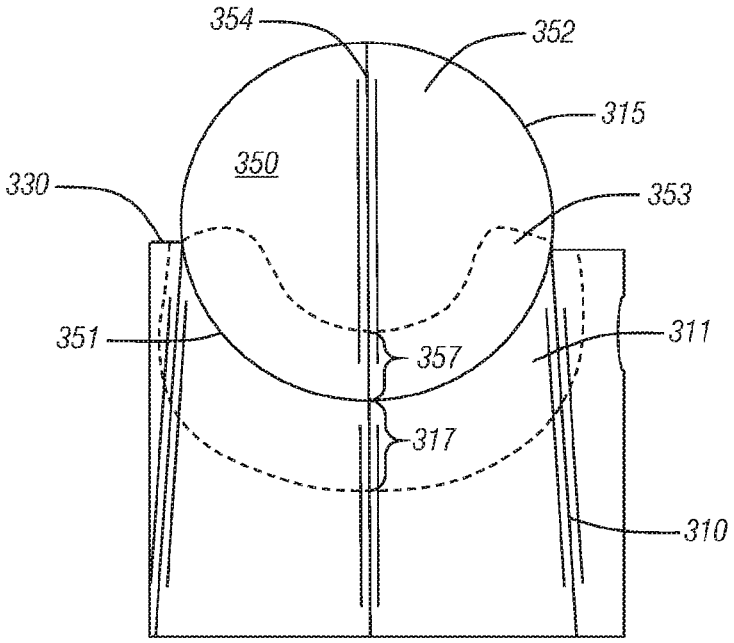
FIG. 6 shows a partial front view of a non-planar cutting element coupled to a blade, according to some embodiments of the present disclosure.

FIG. 6 shows a partial front view of another example of a non-planar cutting element 350 in a pocket at the interface of (or between) the front face 310 and top face 330 of a blade, where the cutting face 352 of the non-planar cutting element 350 and blade front face 310 have adjacent portions of a substantially corresponding geometry that substantially align. The non-planar cutting element 350 has a non-planar cutting face 352 having an elongated crest 354 extending fully or partially between opposing sides defined by the peripheral edge 315 of the non-planar cutting face 352. A portion 353 of the cutting face 352 adjacent to an interface 351 between the outer perimeter of the non-planar cutting face 352 and the inner wall of the pocket has a substantially corresponding geometry that substantially aligns with an adjacent portion 311 of the blade front face 310. The adjacent portion 353 of the cutting face 352 may extend a selected or set distance 357 from the interface 351, and the adjacent portion 311 of the blade front face 310 may extend a selected distance 317 from the interface 351. In some embodiments, the distance 357 may extend a full or partial diameter or width of the cutting face 352. In some embodiments, the distance 317 may extend a full or partial distance between the interface 351 and a base of the blade (where the blade meets the tool body).

According to embodiments of the present disclosure, the blade front face surrounding a non-planar cutting element may have substantially corresponding geometry that substantially aligns with the non-planar cutting element's cutting face when within a distance of up to 0.25 in. (6.35 mm) along the blade front face from the interface between the non-planar cutting element and blade. In some embodiments, the blade front face surrounding a non-planar cutting element may have substantially corresponding geometry that substantially aligns with the non-planar cutting element's cutting face within a distance along the blade front face from the interface between the non-planar cutting element and blade to the base of the blade. In some embodiments, the blade front face surrounding a non-planar cutting element may have substantially corresponding geometry that substantially aligns with the non-planar cutting element's cutting face within a distance along the blade front face from the interface between the non-planar cutting element and blade partially to the base of the blade. For example, the geometry of the front face may transition from an undulating or otherwise contoured geometry within the distance from the interface to a planar geometry extending the remaining height of the blade to the base of the blade.

Figure 7:
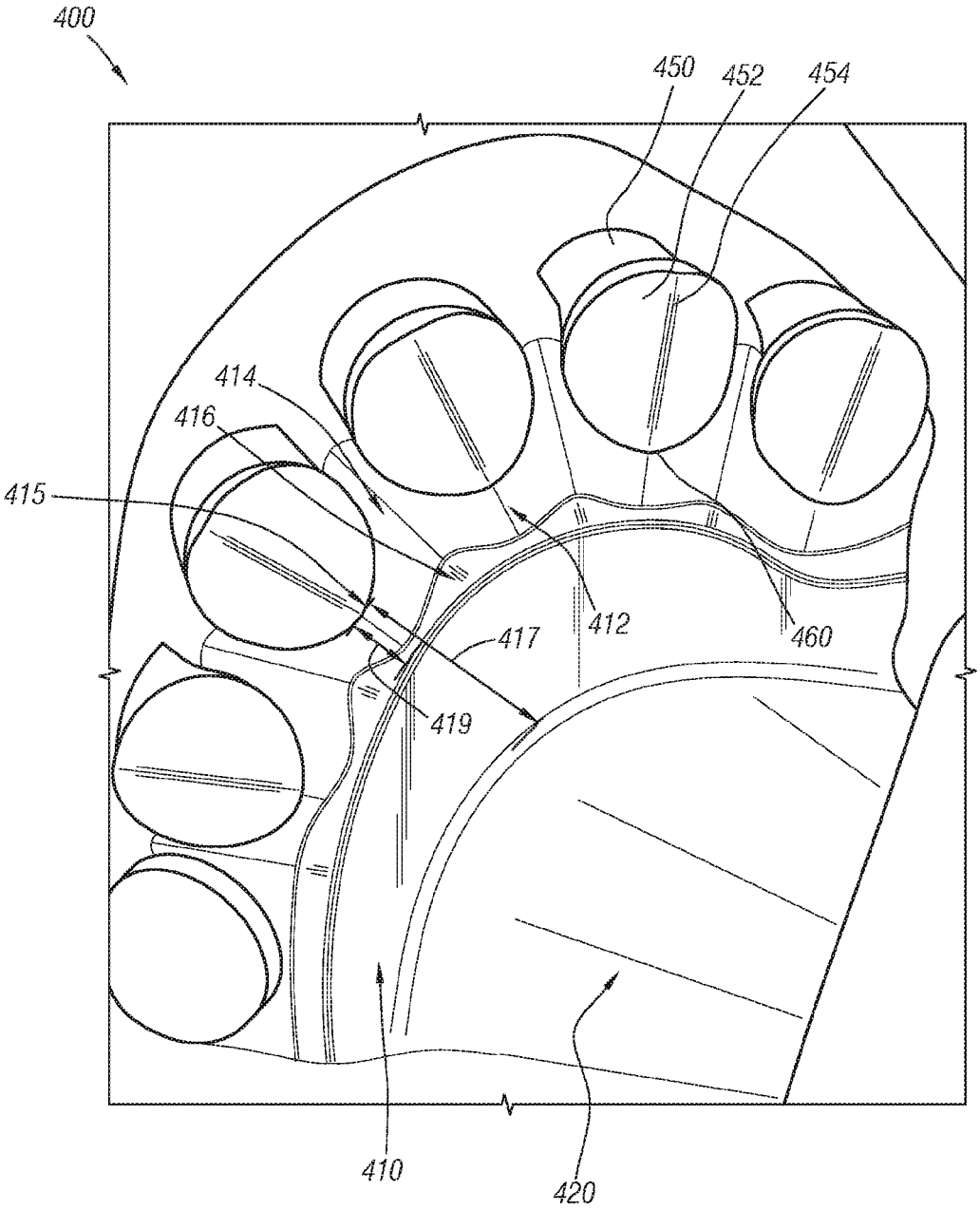
FIG. 7 shows a partial view of non-planar cutting elements coupled to a blade, according to some embodiments of the present disclosure.

FIG. 7 shows an example of a blade having a front face 410 with geometry transitioning from an undulating geometry to a planar geometry. The undulating geometry of the front face 410 includes a plurality of alternating ridges 412 and valleys 414, which transition to a planar geometry at a lower portion of the blade front face 410. In some embodiments, the transition between the undulating geometry and a planar geometry (or other geometry that does not substantially correspond with the geometry of cutting elements) may include a substantially smooth transition between the ridges 412 and the planar geometry and a plurality of slanted surfaces 416 formed between the valleys 414 and the planar geometry. The slanted surfaces 416 transitioning from the valleys 414 to the planar surface of the blade front face 410 may form an obtuse angle with the planar surface of the blade front face, where the transition between the slanted surfaces 416 and planar surface is rounded. For example, the slanted surfaces 416 may extend from the planar surface of the blade front face at an obtuse angle ranging from greater than 90 degrees, greater than 100 degrees, greater than 120 degrees, or greater than 150 degrees, depending on, for example, the height of the blade and the depth of the valley. In other embodiments, the slanted surfaces 416 may be at acute angles or at an obtuse angle greater than 150 degrees. In the embodiment shown, the transitions between the slanted surfaces 416 and the valleys 414 and ridges 412 are also rounded. In some embodiments, a gradual transition may be formed between an undulating and planar geometry, where both the ridges and valleys of the undulating geometry gradually flatten to the planar geometry. For example, the radius of curvature of the ridges 412 and valleys 414 may gradually increase away from the cutting element until they are a substantially planar blade surface. In some embodiments, the slanted surfaces 416 may not be present between the ridges 412 and the lower portion of the blade front face 410 (e.g., the ridges 412 may transition directly into the blade front face 410), while in some embodiments, the slanted surfaces 416 may be present between both of the ridges 412 and valleys 414 and the lower portion of the blade front face 410.

A plurality of cutting elements 450 are in pockets 460 at the cutting edge of the blade and adjacent to the undulating or otherwise contoured geometry. The illustrated cutting elements 450 are positioned in the pockets and have non-planar cutting faces 452 oriented such that the non-planar cutting faces 452 face generally in the same direction as the front face 410 (e.g., the cutting elements 450 have a longitudinal axis that is oriented generally perpendicularly to the bit axis).

In the embodiment shown, the non-planar cutting faces 452 have an elongated crest 454 extending from one portion of an outer perimeter of the non-planar cutting face 452 to another. A portion of the blade front face 410 that is adjacent the interface between the outer perimeter of the non-planar cutting face 452 and the inner wall of the pocket 460 may have an undulating or otherwise contoured geometry that corresponds to and substantially aligns with an adjacent portion of the cutting element cutting face 452. The adjacent portions of the non-planar cutting face 452 and the surrounding front face 410 that have substantially corresponding geometry and substantially align (e.g., the aligning front face ridges 412 and the cutting face elongated crests 454) extend a distance from the interface between the outer perimeter of the non-planar cutting face 452 and the inner wall of the pocket 460. In other words, within a selected or set distance from the interface between the cutting element and the blade, the portion of the blade front face 410 adjacent to the cutting face 454 has a corresponding geometry that aligns to the cutting face 454.

According to embodiments of the present disclosure, a non-planar blade front face geometry corresponding with an adjacent non-planar cutting face geometry (e.g., an undulating geometry including alternating ridges and valleys or other non-planar geometry corresponding with an adjacent non-planar cutting face geometry) may extend a height 419 along the blade front face from the base of the pocket at the interface between the cutting element 450 and the front face, down toward the bit body. The height 419 may be within a range having lower values, upper values, or both lower and upper values including any of 0.1 in. (2.54 mm), 0.5 in. (12.7 mm), 0.75 in. (19.05 mm), 1.0 in. (25.4 mm), or values therebetween. For instance, the height 419 may be at least 0.1 in. (2.54 mm), at least 0.5 in. (12.7 mm), at least 0.75 in. (19.05 mm), at least 1.0 in. (25.4 mm), or between 0.5 in. (12.7 mm) and 1.0 in. (25.4 mm). In other embodiments, the height 419 may be less than 0.1 in. (2.54 mm) or greater than 1.0 in. (25.4 mm). The height 419 may be selected based on a variety of factors including the size of the blade. According to some embodiments, a non-planar blade front face geometry (e.g., an undulating geometry including alternating ridges and valleys or other non-planar geometry corresponding with adjacent non-planar cutting face geometry) may extend at least 5%, at least 10%, at least 15%, at least 20%, at least 25%, at least 35%, at least 45%, at least 50%, or up to the entire height 417 along the blade front face from the tool body (at the base of the blade) to a lowermost point of a pocket (i.e., point of a pocket opening around the blade front face that is closest to the base of the blade). For example, as shown in FIG. 7, one or more ridges 412 of the blade front face undulating geometry that corresponds with an adjacent non-planar cutting face geometry may extend a partial height 419 along the blade front face (e.g., at least 0.1 in. (2.54 mm) or at least 10% of the blade height 417 measured from the tool body 420 to a lowermost point 415 of a pocket 460 (where a lowermost point of a pocket refers to a point of the pocket opening to the blade front face that is closest to the blade base, or that is closest to the tool body from which the blade extends).

In some embodiments, the entire non-planar cutting face may have a geometry that corresponds with and substantially aligns with the adjacent blade front face geometry. In some embodiments, a portion of a non-planar cutting face, but not the entire non-planar cutting face, may have a geometry that corresponds with and substantially aligns with the adjacent blade front face geometry. For example, the non-planar cutting face geometry may include an elongated crest having a shape and size generally matching the shape and size of an aligning blade front face ridge, where the elongated crest extends partially across the non-planar cutting face and then gradually or abruptly transitions to a different shape. In other words, a portion of a non-planar cutting face adjacent to an interface with the blade front face may have a crest or ridge having a geometry that corresponds to and substantially aligns with an adjacent portion of the blade front face, while another portion of the non-planar cutting face (e.g., a distal portion of the cutting face from the interface with the blade front face) may have a different geometry. For example, an elongated crest may extend partially across the cutting face and transition to a substantially planar surface, where the elongated crest substantially aligns and corresponds with an adjacent portion of the blade front face geometry. In another example, an elongated crest may extend partially across the cutting face and transition to one or more different elongated crests extending in different directions across the cutting face, where the elongated crest substantially aligns and corresponds with an adjacent portion of the blade front face geometry. In another example, an elongated crest may extend partially across the cutting face and transition to a different non-planar geometry, where the elongated crest substantially aligns and corresponds with an adjacent portion of the blade front face geometry.

According to embodiments of the present disclosure, aligning and corresponding geometry of a blade front face and non-planar cutting element cutting face may extend a distance from the interface between the non-planar cutting element and blade pocket toward the bit body (419 in FIG. 7) ranging from, for example, a value of 0.1 in. (2.54 mm), 0.5 in. (12.7 mm), 1.0 in. (25.4 mm), 2.0 in. (50.8 mm) or 3.0 in. (76.2 mm), where any value may be used in combination with any other value (e.g., a range of 0.1 in. (2.54 mm) to 3.0 in. (76.2 mm) or a range of 0.1 in. (2.54 mm) to 1.0 in. (25.4 mm)). In some embodiments, the distance of corresponding geometry of the blade front face may be at least 50% the diameter/width of the non-planar cutting element, at least 100% the diameter/width of the non-planar cutting element, or at least 150% the diameter/width of the non-planar cutting element. In some embodiments, the distance of corresponding geometry of the non-planar cutting element may be at least 25% the diameter/width of the non-planar cutting element, at least 50% the diameter of the non-planar cutting element, or at least 100% the diameter of the non-planar cutting element.

An undulating or otherwise contoured front face of a blade may have alternating ridges and valleys, where the ridges may have the same or different radii of curvature, and where the valleys may have the same or different radii of curvature. According to embodiments of the present disclosure, one or more ridges of an undulating blade front face may have a radius of curvature having a lower value, an upper value, or both lower and upper values including any of 0.03 in. (0.76 mm), 0.05 in. (1.27 mm), 0.1 in. (2.54 mm), 0.15 in. (3.81 mm), 0.2 in. (5.08 mm), 0.25 in. (6.35 mm), 0.3 in. (7.62 mm), or any value therebetween, where any value may be used in combination with any other value (e.g. 0.03 in. (0.76 mm) to 0.3 in. (7.62 mm) or 0.03 in. (0.76 mm) to 0.1 in. (2.54 mm)). Different ridges may have different radii of curvature. For instance, different ridges of differing radii of curvature may correspond with cutting elements having different non-planar cutting face geometry, to allow for closer spacing between adjacent ridges, to reduce stress in the front face geometry, or for any other reason. Further, in some embodiments, one or more ridges may have a varying radius of curvature along its height. For example, one or more ridges may have a relatively smaller radius of curvature at or near a pocket, a relatively larger radius of curvature at or near a base of the blade (or at the base of the undulating portion of the blade), and a gradually transitioning radii of curvature from the relatively smaller radius of curvature to the relatively larger radius of curvature.

According to embodiments of the present disclosure, one or more valleys of an undulating blade front face may have a radius of curvature with a lower value, an upper value, or both lower and upper values including any of 0.03 in. (0.76 mm), 0.05 in. (1.27 mm), 0.1 in. (2.54 mm), 0.15 in. (3.81 mm), 0.2 in. (5.08 mm), 0.25 in. (6.35 mm) or 0.3 in. (7.62 mm), or any value therebetween, where any value may be used in combination with any other value (e.g., 0.03 in. (0.76 mm) to 0.3 in. (7.62 mm), or 0.03 in. (0.76 mm) to 0.15 in. (3.81 mm)). Different valleys may have different radii of curvature, for example, to allow for closer or farther spacing between adjacent ridges, to reduce stress in the front face geometry, or for any other reason. For example, at least two valleys of an undulating front face geometry may have different radii of curvature, where a first valley having a relatively smaller radius of curvature is formed between two ridges that are relatively closer together than a second valley having a relatively larger radius of curvature formed between two ridges that are relatively farther apart. Further, in some embodiments, one or more valleys may have a varying radius of curvature along its height. For example, one or more valleys may have a relatively smaller radius of curvature at or near a pocket and/or top of the blade, a relatively larger radius of curvature at or near a base of the blade (or at the base of the undulating portion of the blade), and a gradually transitioning radii of curvature from the relatively smaller radius of curvature to the relatively larger radius of curvature. In other embodiments, one or more valleys may transition to a generally flat or planar surface near the base of the blade.

According to embodiments of the present disclosure, a non-planar cutting element may have one or more elongated crests or peaks having a radius of curvature having a lower value, an upper value, or both lower and upper values including, for example, 0.03 in. (0.76 mm), 0.05 in. (1.27 mm), 0.1 in. (2.54 mm), 0.15 in. (3.81 mm), 0.2 in. (5.08 mm), 0.25 in. (6.35 mm), 0.3 in. (7.62 mm), or any value therebetween, where any limit may be used in combination with any other limit. In other embodiments, the radius of curvature may be less than 0.03 in. (0.765 mm) or greater than 0.3 in. (7.62 mm). The radius of curvature may vary depending on, for example, the size of the cutting element, the material of the cutting end (e.g., thermally stable diamond cutting face, polycrystalline diamond cutting face, diamond composite cutting face, etc.), the number of elongated crests or peaks formed in the cutting face, or other variables.

According to some embodiments, one or more ridges of an undulating blade front face geometry that align with an elongated crest or peak of a non-planar cutting face may have a radius of curvature that is less than, greater than, or equal to the radius of curvature of the elongated crest. For example, in some embodiments, the radius of curvature of a ridge formed in a blade front face may be greater than (e.g. between greater than 100% and 200%, up to 125%, up to 150%, up to 175%, up to 200%, etc.) the radius of curvature of an adjacent crest formed on the non-planar cutting face of an adjacent non-planar cutting element. In some embodiments, adjacent portions of a ridge and an elongated crest may have substantially equal radii of curvature.

Figure 8:
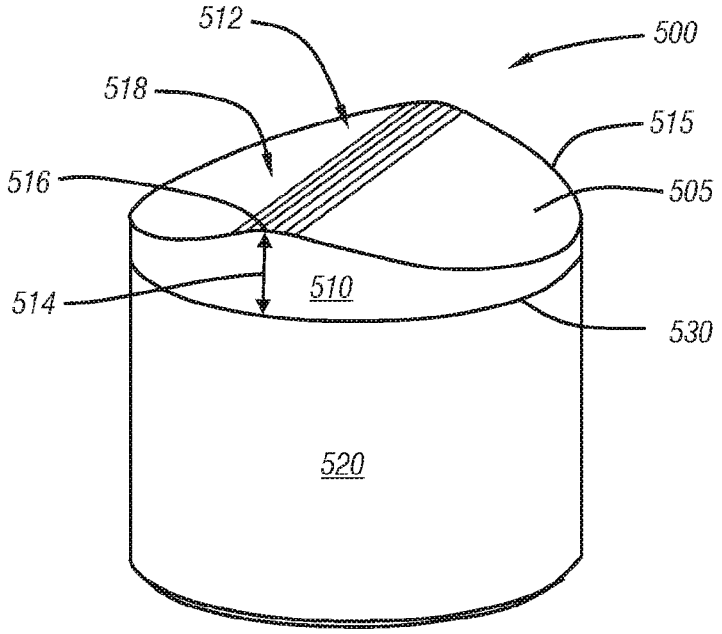
FIGS. 8 and 9 show a cutting element having a non-planar cutting face, according to some embodiments of the present disclosure.
Figure 9:
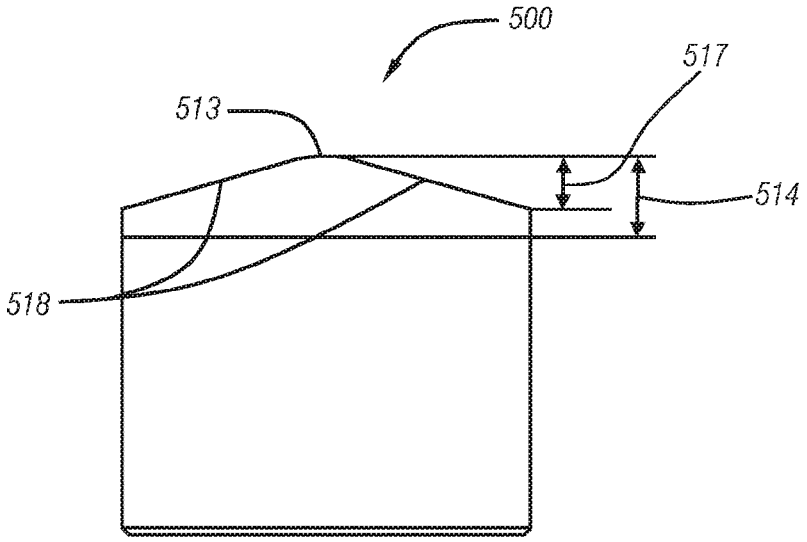

FIGS. 8 and 9 show an example of a non-planar cutting element 500 having a non-planar cutting face 505. The cutting element 500 has an ultrahard layer 510 on a substrate 520 at an interface 530, where the non-planar cutting face 505 is on the ultrahard layer 510. The ultrahard layer 510 has a peripheral edge 515 formed at the intersection of the cutting face 505 and the outer perimeter (or outer side surface) of the ultrahard layer surrounding the non-planar cutting face 505. The cutting face 505 has an elongated crest 512 extending a height 514 above the substrate 520, and at least one recessed region 518 extending laterally from crest 512. The crest 512, proximate a portion of the peripheral edge 515, forms a first cutting edge portion 516. The peripheral edge 515 may be contoured and transition from a peak 513 at the cutting edge portion 516 to a valley proximate at least one recessed region 518, and the peripheral edge 515 may continuously or otherwise decrease in height in a direction away from the crest 512.

As shown, the recessed regions 518 may extend a height 514 above the substrate or interface 530 (along the circumference), but may have a height differential 517 (from the first cutting edge portion 516 to the lowest portion of the recessed regions 518), which is also equal to the total variation in height of the cutting face 505. According to some embodiments, a non-planar cutting face of a cutting element may have a height differential 517 ranging between 0.04 in. (1.02 mm) and 0.2 in. (5.08 mm) depending on the overall size of the cutting element. For example, the height differential 517 may be defined relative to the cutting element diameter/width and may be between 10% and 50% of the diameter/width of the cutting element, between 15% and 40% of the diameter/width of the cutting element, or between 20% and 30% of the diameter/width of the cutting element. In other embodiments, the height differential 517 may be less than 10% or more than 50% of the diameter/width of the cutting element. Additionally, in one or more embodiments, the height of the ultrahard layer 510 at the peripheral edge adjacent recessed region 518 (i.e., at the side of the cutting element having the lowest ultrahard layer 510 height) may be at least 0.02 in. (0.51 mm), at least 0.04 in. (1.02 mm), or at least 0.06 in. (1.52 mm).

Substrates of a non-planar cutting element may be formed of cemented carbides, such as tungsten carbide, titanium carbide, chromium carbide, niobium carbide, tantalum carbide, vanadium carbide, or combinations thereof cemented with iron, nickel, cobalt, or alloys thereof. For example, a substrate may be formed of cobalt-cemented tungsten carbide. Ultrahard layers of a non-planar cutting element (forming the non-planar cutting face) may be formed of, for example, polycrystalline diamond, such as diamond crystals bonded together by a metal catalyst such as cobalt or other Group VIII metals under sufficiently high pressure and high temperatures (sintering under HPHT conditions); thermally stable polycrystalline diamond (polycrystalline diamond having at least some or substantially all of the catalyst material removed or formed from catalysts having less thermal expansion coefficient mismatch with diamond); or cubic boron nitride. The ultrahard layer may be formed from one or more layers, which may have a gradient or stepped transition of diamond content therein. In such embodiments, one or more transition layers (as well as the outer layer) may include metal carbide particles therein. Further, when such transition layers are used, the combined transition layers and outer layer may collectively be referred to as the ultrahard layer, as that term has been used in the present application. That is, the interface surface on which the ultrahard layer (or plurality of layers including an ultrahard material) may be formed is that of the cemented carbide substrate. In yet other embodiments, non-planar cutting elements may be formed entirely of a hard material (without a substrate), such as a bulk polycrystalline diamond material, diamond grit impregnated inserts ("grit hot-pressed inserts" or "GHIs") or tungsten carbide inserts.

Non-planar cutting elements may have other non-planar cutting faces, including one or more peaks or elongated crests forming one or more raised cutting edge portions (e.g., the first cutting edge portion 516 shown in FIGS. 8 and 9) along the outer perimeter of the non-planar cutting face. Further, one or more raised cutting edge portions of a non-planar cutting face may have the same height or different heights. For example, a non-planar cutting element may have a non-planar cutting face with an elongated crest extending across the cutting face, from a first raised cutting edge portion to a second raised cutting edge portion at the same height as, or higher than, the first raised cutting edge portion.

Figure 10:
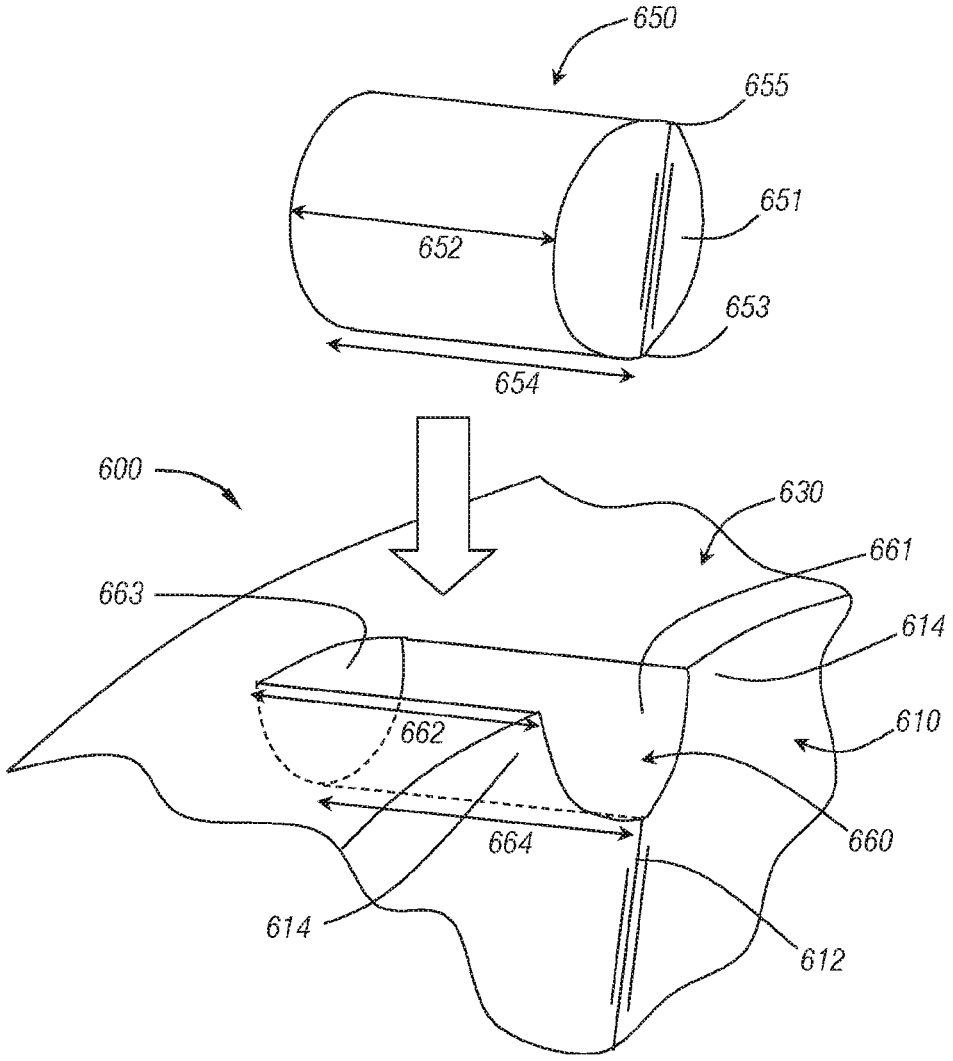
FIG. 10 shows a partial view of a non-planar cutting element and blade, according to some embodiments of the present disclosure.

Varying heights of the peripheral edge of a non-planar cutting face may correspond with varying lengths of a pocket inner wall, such that when the non-planar cutting element is in the pocket, there is substantially no exposed pocket inner wall and in some embodiments, no exposed side surface of the non-planar cutting face along the interface between the non-planar cutting element and pocket. For example, referring to FIG. 10, a non-planar cutting element 650 has a non-planar cutting face 651 with an elongated crest between two sloping side surfaces and extending from a first raised cutting edge portion 653 to a second raised cutting edge portion 655. The non-planar cutting element has a greatest height 654 measured from the base surface of the cutting element 650 to the first raised portion 653 (which may also be equal to the height between the base surface and the second raised cutting edge portion 655) and smallest heights 652 measured from the base surface to the lowest cutting edge portions along the surfaces sloping downwardly from the elongated crest. The pocket 660 is at an interface between the top face 630 of a blade 600 and the front face 610 of the blade 600. The pocket 660 has an inner wall 661 with varying lengths from a back wall 663 to the front face 610, such that the front face 610 around the pocket opening has a non-planar geometry. In the embodiment shown, the inner wall 661 has a greatest length 664 extending from the base surface 663 to a ridge 612 formed in the front face 610 of the blade and smallest lengths 662 extending from the base surface 663 to valleys 614 on either side of the ridge 612 in the front face 610 of the blade. The greatest length 664 of the pocket 660 may be approximately equal to the greatest height 654 of the cutting element 650, and the smallest lengths 662 of the pocket 660 may be approximately equal to the smallest heights 652 of the cutting element. Therefore, in some embodiments, when the cutting element 650 is fitted within the pocket 660, the geometry of the cutting edge generally corresponds with the geometry of the front face 610 along the interface between the cutting element 650 and pocket inner wall 661.

In some embodiments, more than one type of cutting element may be on a blade having a non-planar front face. For example, in some embodiments, a first type of non-planar cutting element may be in a pocket at a blade cutting edge (extending along the blade top face to the blade front face), and a second, different type of cutting element (e.g., a substantially pointed cutting element or other non-planar cutting element) may be coupled to the blade in a pocket formed in a top face of the blade. Different cutting element types may be arranged on the blade in an alternating pattern, one type of cutting element may trail another type of cutting element (e.g., a first type of cutting element at a cutting edge or proximate the front face of a blade and a second type of cutting element behind the first type of cutting element relatively farther from the blade front face), or a combination of alternating and trailing arrangements may be used (e.g., different types of cutting elements may have an overlapping radial position along the blade where one cutting element (a trailing cutting element) is relatively farther from the blade front face than other cutting element (the leading cutting element)). Other cutting element arrangements may be used, where at least one non-planar cutting element is coupled to a blade having its non-planar cutting face substantially aligned with a non-planar geometry formed in the blade front face. In some embodiments, the blade front face may include both planar cutting elements and non-planar cutting elements (as well as multiple types or geometries of non-planar cutting elements), and the blade front face may correspond to both the planar cutting elements and the non-planar cutting elements. For example, the blade front face may include ridges and valleys adjacent to and corresponding with the non-planar cutting elements, and may be flat adjacent to and corresponding with the planar cutting elements. In such embodiments the planar cutting elements corresponding to a flat blade face may alternate with the non-planar cutting elements corresponding to an undulating blade front face, or in some embodiments, the planar cutting elements corresponding with a flat blade front face may be placed at one or more portions of the cutting element profile (e.g., at the gage region of the cutting profile), and the non-planar cutting elements and corresponding undulating blade front face may be placed at one or more other portions of the cutting element profile (e.g., at the remaining portions of the blade profile including the shoulder).

Figure 11:
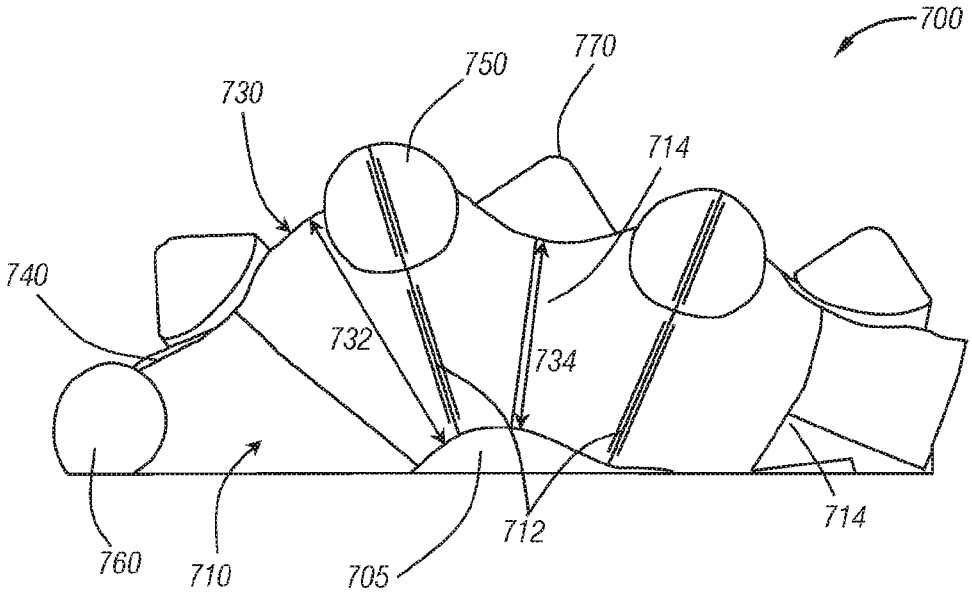
FIG. 11 shows a front view of a blade, according to some embodiments of the present disclosure.

FIG. 11 shows a partial view of a blade with a non-planar front face and a non-planar top face according to embodiments of the present disclosure. The blade 700 has a plurality of pockets in a first row along a cutting edge 740 of the blade, extending along the top face 730 of the blade to the blade front face 710. A first type of non-planar cutting element 750 is in at least one of the first row of pockets. In some embodiments, the first type of cutting elements may have a non-planar cutting face with an elongated crest extending fully or partially across the diameter/width of the cutting face. In other embodiments, other non-planar cutting elements may be disposed along the cutting edge of a blade. The non-planar cutting elements may, in some embodiments, have at least one raised cutting edge portion at a portion of the peripheral edge of the cutting element non-planar cutting face. Further, the same or different types of planar or non-planar cutting elements may be along the cutting edge of a blade. For example, in the embodiment shown, a combination of cutting elements having a planar cutting face 760 and the first type of cutting elements 750 may be in the first row of pockets along the cutting edge 740 of the blade. In other embodiments, a single type of non-planar cutting elements may be in the pockets along the cutting edge of a blade, or multiple types of non-planar cutting elements may be in the pockets along the cutting edge of the blade.

The front face 710 of the blade 700 of FIG. 11 has a plurality of alternating ridges 712 and valleys 714. The alternating ridges 712 and valleys 714 may form a generally undulating geometry within a distance from the first type of non-planar cutting elements 750. The non-planar cutting elements 750 are positioned in the pockets such that the geometry of the non-planar cutting faces of the first type of non-planar cutting elements 750 generally aligns with the undulating geometry of the blade front face 710. For example, in the embodiment shown, the undulating geometry of the front face 710 corresponds with the geometry of the non-planar cutting faces such that portion of the cutting faces of the non-planar cutting elements 750 adjacent the blade front face 710 forms a substantially continuous undulating geometry. In other words, the substantially continuous undulating geometry includes a plurality of alternating ridges and valleys, where the ridge geometry is formed in part by the elongated crests of the non-planar cutting elements 750 and in part by the ridges 712 of the blade front face 710, and where the valley geometry is formed in part by the sloping surfaces of the non-planar cutting elements cutting faces and in part by the valleys 714 of the blade front face 710.

A second type of non-planar cutting element 770 is illustrated in a second row of pockets in a top surface 730 of the blade. The second type of non-planar cutting elements 770 may have any suitable shape, but are shown in FIG. 11 as having substantially pointed cutting ends pointing outwardly from the top face 730 of the blade. The second row of non-planar cutting elements 770 may be farther from the blade front face 710 than the first row of non-planar cutting elements 750. In some embodiments, the first type of non-planar cutting elements 750 are in an alternating arrangement with the second type of non-planar cutting elements 770. In other words, along a first dimension of the blade 700 from the blade front face 710 to the blade trailing face (e.g., across a thickness of the blade), the first type of cutting elements 750 and the second type of cutting elements 770 are arranged in two rows in different first dimension positions. In some embodiments, the cutting elements in the second row may overlap in the first dimension with the cutting elements in the first row. Along a second dimension of the blade, parallel with the blade top face 730 and perpendicular to the first dimension (e.g., in a radial direction as shown in FIG. 11), the second type of cutting elements may be in alternating positions with the first type of cutting elements 750.

A blade height is measured along a third dimension (generally perpendicular to both the first and second dimensions) from a tool body 705 to the blade top face 730. In the embodiment shown, the blade 700 extends from the tool body 705 to a first height 732 adjacent a first cutting element 750 and to a second height 734, different from the first height 732, adjacent a second cutting element 770. The blade may be relatively taller around the first type of cutting elements 750, and the blade may be relatively shorter around the second type of cutting elements 770, such that the top face 730 of the blade has a generally undulating height or other geometry. In some embodiments, a blade may extend from the tool body to a first height, to a second height, smaller than the first height, to a third height, smaller than the first height and greater than the second height, and to a fourth height, smaller than the third height, such that the top face of the blade has a non-uniform undulating geometry. In some embodiments, the blade height may vary along the second dimension of the blade, where different cutting element types are positioned at different blade heights. In some embodiments, the blade height may vary along the first dimension of the blade (from the blade front face to the blade trailing face) in addition to varying the blade height along the second dimension or without varying the blade height along the second dimension. For example, in some embodiments, a blade may have a top face with a generally undulating geometry within a distance from the blade top face and a level geometry (having substantially the same height) within a distance from the blade trailing face, where the undulating geometry smoothly transitions to the level geometry along the first dimension.

Further, in the embodiment shown, the undulating geometry of the blade top face 730 corresponds with the undulating geometry of the blade front face 710, where the relatively taller heights of the blade correspond with the front face ridges 712 and the relatively shorter heights of the blade correspond with the front face valleys 714. In other embodiments, relatively taller blade heights may correspond with front face valleys or otherwise be offset from front face ridges, and relatively shorter blade heights may correspond with front face ridges or otherwise be offset from front face valleys.

According to some embodiments of the present disclosure, a downhole cutting tool may have at least one blade extending from the tool body, where the blade has a top face facing outwardly from the tool body (e.g., toward a formation or workpiece), a front face (e.g., facing the direction of rotation), and at least one pocket formed at an interface between the top face and the front face. The at least one pocket may have an inner wall with varying length, such that an opening of the pocket to the front face of the blade has a non-planar geometry around the perimeter of the opening. A non-planar cutting element may be in the pocket, such that the non-planar geometry of the pocket opening substantially corresponds with the non-planar geometry of the cutting element along the peripheral edge of its non-planar cutting face. When the geometry of the peripheral edge of a cutting element non-planar cutting face substantially corresponds with the geometry of the blade front face surrounding the pocket opening (in which the cutting element is located), there may be substantially no exposed pocket inner wall and no exposed side surface of the non-planar cutting element adjacent the interface between the non-planar cutting element and pocket along the blade front face. In other words, when the geometry of the peripheral edge of a cutting element non-planar cutting face substantially corresponds with the geometry of the blade front face surrounding the pocket opening, the interface between the non-planar cutting element and pocket inner wall may extend to both the non-planar cutting face of the cutting element and the front face of the blade along the pocket opening to the blade front face.

Embodiments of the present disclosure may include downhole cutting tools used to cut, wear, or erode an earthen formation (e.g., drill bits or reamers), steel casing (e.g., window, dress, follow, watermelon, or section mills), plugs or tooling (e.g., junk mills), or other materials. The downhole cutting tools may have one or more blades extending radially from a tool body and a plurality of cutting elements attached to the blades. For example, according to embodiments of the present disclosure, a drill bit may have a plurality of blades extending radially from a bit body, and a plurality of cutting elements attached to the blades. Between the blades are fluid channels through which drilling fluid may flow (exiting nozzles to cool and clean cutting elements and to transport cuttings). The cutting elements may include at least two different types: cutters (having a planar cutting end) and non-planar cutting elements (having a non-planar cutting end). Each blade has a front face (facing in the direction of rotation of the drill bit), a trailing face (opposite the front face), and a top face (facing the formation and extending between the front face and trailing face). The cutting elements can be attached to the blades at different locations on a blade. For example, cutting elements positioned at or near the front face of the blade (and potentially at the interface with the top face) may be referred to as primary cutting elements, whereas cutting elements spaced rearward therefrom (away from the front face) may be referred to as backup or secondary cutting elements. The geometry of the blade front face may correspond with the geometry of the non-planar cutting face of the non-planar cutting elements around the interface between the non-planar cutting elements and the blade to which the non-planar cutting element is coupled.

Downhole cutting tools according to the present disclosure may be made in different ways, depending on the material it is made from. For example, a downhole cutting tool made from a matrix material (e.g., transition metal carbides such as tungsten carbide) may be formed using a mold having a generally negative shape of the downhole cutting tool (including a generally undulating geometry corresponding to at least a portion of at least one cutting tool blade) by loading the matrix material in the mold and infiltrating the matrix material with an infiltration binder. A downhole cutting tool made of steel or other machinable material may be formed by machining the blades extending from a tool body, where at least a portion of at least one blade has a front face with an undulating geometry. A mold or downhole cutting tool may also be made by using additive manufacturing techniques that build the mold or tool layer-by-layer. Non-planar cutting elements having a cutting face with non-planar geometry corresponding to the undulating or otherwise contoured front face geometry may be attached within pockets formed in the blades such that the non-planar cutting face geometry corresponds with the front face geometry.

Figure 12:
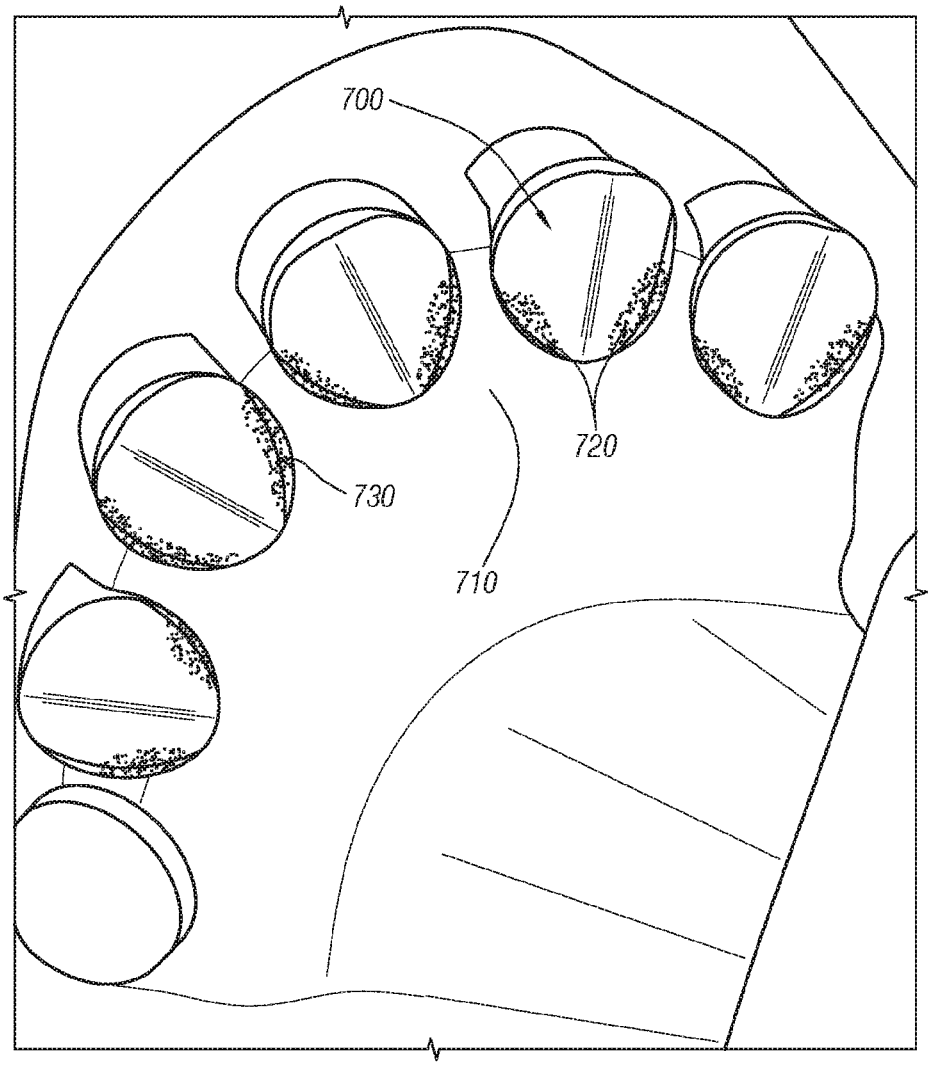
FIG. 12 shows an example of a non-planar cutting element coupled to a blade having a non-aligning front face geometry, according to some embodiments of the present disclosure.

By forming a blade front face geometry around a pocket to match or substantially correspond to the geometry around a peripheral edge of a non-planar cutting element in the pocket, exposed portions of the pocket inner wall and cutting element side surface may be reduced, which may reduce formation cuttings or other free materials from building up around the interface between the non-planar cutting element and blade. In other words, by matching the geometry around the peripheral edge of a non-planar cutting element and surrounding blade front face, a relatively smooth transition across the interface between the blade and non-planar cutting face may be formed, thereby reducing potential cavities or scoops that could trap material. In contrast, in embodiments such as that shown in FIG. 12, a non-planar cutting element 700 may be within a pocket 730 opening to a blade front face 710 and have a non-corresponding or non-aligning geometry with the cutting element cutting face geometry. For instance, the non-planar cutting elements 700 may be positioned in standard pockets for a planar cutting element. In such an embodiment, cuttings 720 may build up and pack around the disjointed transition between the blade front geometry and the cutting face geometry.

According to some embodiments of the present disclosure, a relatively smooth transition across the interface between a blade front face and non-planar cutting element cutting face may be formed by forming the length of the pocket inner wall to substantially equal the height of the non-planar cutting element (measured from the cutting element base surface to its cutting face) around the portion of its peripheral edge aligned to interface the pocket in order to prevent or reduce the amount of packing around the interface between the cutting element and pocket.

Although just a few example embodiments have been described in detail above, those skilled in the art will readily appreciate that many modifications are possible in the example embodiments without materially departing from the apparatus, systems, and methods disclosed herein. Accordingly, such modifications are intended to be included within the scope of this disclosure. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

In the claims, any means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function or other functional claiming for any limitations of any of the claims herein, except for those in which the claim expressly uses the words 'means for' together with an associated function. Each addition, deletion, and modification to the embodiments that fall within the meaning and scope of the claims is to be embraced by the claims. The features of any embodiment(s) herein may be combined with features of any other embodiments herein.

What is claimed is:

1. A downhole cutting tool, comprising:

a tool body;

at least one blade extending from the tool body, the blade including:

a front face having an undulating geometry including a plurality of alternating ridges and valleys; and a top face facing outwardly from the tool body and transitioning to the front face at a cutting edge; and at least one cutting element disposed in a pocket at the cutting edge adjacent to the undulating geometry of the front face, a non-planar cutting face of the cutting element facing the same direction as the front face, and the non-planar cutting face including at least two sloping surfaces meeting at an elongated crest.

2. The cutting tool of claim 1, wherein adjacent portions of the non-planar cutting face and the front face have corresponding geometries that align within a distance up to 0.25 in.

3. The cutting tool of claim 2, wherein the adjacent portion of the front face extends a distance from the interface between the non-planar cutting face and the front face to a base of the blade.

4. The cutting tool of claim 2, wherein the geometry of the front face transitions from the undulating geometry to a planar geometry.

5. The cutting tool of claim 2, wherein at least one of the ridges of the front face having corresponding geometry that aligns with the non-planar cutting face extends a full diameter of the non-planar cutting face.

6. The cutting tool of claim 1, wherein at least one of the ridges of the undulating front face geometry has a radius of curvature between 0.03 inch and 0.3 inch.

7. The cutting tool of claim 1, wherein at least one of the valleys of the undulating front face geometry has a radius of curvature between 0.03 inch and 0.3 inch.

8. The cutting tool of claim 1, wherein at least two of the valleys of the undulating front face geometry have different radii of curvature.

9. The cutting tool of claim 1, wherein the at least one cutting element comprises at least one different type of cutting element in a respective pocket in the top face of the blade.

10. The cutting tool of claim 9, wherein the at least one different type of cutting element includes a pointed cutting end pointing outwardly from the top face of the blade.

11. The cutting tool of claim 9, wherein the at least one cutting element comprises the cutting element in the pocket at the cutting edge and a second cutting element in a second pocket at the cutting edge, and the at least one different type of cutting element is in a position along the top face of the blade between the cutting element and the second cutting element of the at least one cutting element.

12. The cutting tool of claim 1, wherein the blade extends from the tool body to a first height adjacent to a first cutting element and a second height, different from the first height, adjacent to a second cutting element.

13. The cutting tool of claim 1, wherein the elongated crest substantially aligns with one of the alternating ridges such that a portion of the elongated crest adjacent the front face is within 0.25 inch of a crest of the one of the alternating ridges.

14. The cutting tool of claim 1, wherein one of the alternating ridges aligns with the elongated crest, the ridge having a radius of curvature that is greater than or equal to the radius of curvature of the elongated crest.

15. The cutting tool of claim 1, wherein at least one of the alternating ridges extends at least 10% of a height of the blade from the tool body to a lowermost point of the pocket.

16. A downhole cutting tool, comprising:

a tool body;

at least one blade extending from the tool body, the blade including:

a top face facing outwardly from the tool body;

a front face that interfaces with the top face at a cutting edge; and at least one pocket at the cutting edge having an inner wall having a length from the back of the pocket to the front face that varies, such that an opening of the pocket to the front face has a non-planar geometry around the perimeter of the opening at the front face; and a cutting element in the at least one pocket, the cutting element having a non-planar cutting face having a non-planar geometry along peripheral edge of the non-planar cutting face, the non-planar geometry of the pocket opening substantially corresponding with the non-planar geometry of the cutting element along the peripheral edge of the non-planar cutting face.

17. The cutting tool of claim 16, further comprising at least one different type of cutting element in another pocket on the blade.

18. The cutting tool of claim 16, wherein the blade extends from the tool body to a first height adjacent a first cutting element and a second height, different from the first height.

19. The cutting tool of claim 16, wherein the non-planar geometry of the cutting element along the peripheral edge of the non-planar cutting face includes at least one crest.

20. A method of manufacturing a cutting tool having a tool body with at least one blade extending from the tool body, the blade including a front face having an undulating geometry comprising a plurality of alternating ridges and valleys, a top face facing outwardly from the tool body that interfaces with the front face at a cutting edge, and at least one pocket at the cutting edge adjacent to the undulating geometry of the front face, the method comprising:

placing at least one cutting element having a non-planar cutting face in the at least one pocket, the non-planar cutting face including at least two sloping surfaces meeting at an elongated feature; and orienting the at least one cutting element such that the elongated feature substantially aligns with at least one of the ridges or the valleys of the front face.

* * * * *